US009365329B1

(12) United States Patent
Chang

(10) Patent No.: US 9,365,329 B1
(45) Date of Patent: Jun. 14, 2016

(54) CONTAINER SEAL

(71) Applicant: Tsung-Chih Chang, Taichung (TW)

(72) Inventor: Tsung-Chih Chang, Taichung (TW)

( * ) Notice: Subject to any disclaimer, the term of this patent is extended or adjusted under 35 U.S.C. 154(b) by 0 days.

(21) Appl. No.: 14/600,600

(22) Filed: Jan. 20, 2015

(51) Int. Cl.
*A47G 19/14* (2006.01)
*B65D 39/00* (2006.01)

(52) U.S. Cl.
CPC ..... *B65D 39/0052* (2013.01)

(58) Field of Classification Search
CPC ..... B65D 51/18; B65D 55/16; B65D 17/166; A47G 19/14
USPC ..... 220/259.1, 259.5, 282, 283, 553, 244, 220/254.1, 780, 522; 215/228, 270
See application file for complete search history.

(56) References Cited

U.S. PATENT DOCUMENTS 5,884,793 A * 3/1999 Wang ..... B65D 47/0838 215/229
6,763,963 B1 * 7/2004 Martin ..... B65D 17/166 220/212
7,134,454 B2 * 11/2006 Montminy ..... F16L 55/1157 138/89
7,597,211 B2 * 10/2009 Kang ..... A45D 33/006 132/293
7,658,295 B2 * 2/2010 Hoepner ..... B65D 47/0885 215/235
8,020,720 B2 * 9/2011 Duquet ..... B65B 61/186 220/254.3
2003/0222083 A1 * 12/2003 Pladsbjerg ..... B65D 17/165 220/254.3
2004/0084452 A1 * 5/2004 Hsieh ..... A47G 19/2272 220/256.1
2005/0133475 A1 * 6/2005 Goto ..... B65D 47/0814 215/237
2005/0167388 A1 * 8/2005 Bocola ..... A45D 40/0068 215/235
2008/0047962 A1 * 2/2008 Muriel Salvador .. B65D 17/166 220/259.1
2010/0236966 A1 * 9/2010 Luttik ..... B65D 21/022 206/508
2011/0290800 A1 * 12/2011 Teys ..... B65D 75/367 220/259.1

* cited by examiner

*Primary Examiner* — King M Chu
(74) *Attorney, Agent, or Firm* — Trop Pruner & Hu, P.C.

(57) ABSTRACT

A container seal includes a positioning unit and a sealing unit. The positioning unit has a positioning member, a support member, and a passage extending along an axis. The support member includes a surrounding wall defining a top opening that communicates with the passage, a fixing part and an abutting part. The sealing unit includes an elastic cover member, and a connecting member connected to the fixing part. The cover member has front and rear ends, and a pressing portion pressable to convert the cover member from a covering position, where the cover member is tilted relative to the axis, abuts against the abutting part, and covers the top opening, to an opening position, where the cover member uncovers the support member.

10 Claims, 8 Drawing Sheets

CONTAINER SEAL

FIELD OF THE INVENTION

The invention relates to a container seal, more particularly to a container seal operable to cover and uncover a mouth of a container.

BACKGROUND OF THE INVENTION

European Patent No. EP0790192 B1 discloses a conventional container seal that includes a lower wall, an upper wall and a living hinge interconnecting the lower wall and the upper wall. The lower wall includes a rim portion that defines an annular groove, and is formed with a plurality of dispensing openings. The upper wall has a central portion surrounded by the living hinge, and a peripheral outer portion. The conventional container seal is mounted to a mouth of a container through engagement between the annular groove of the conventional container seal and a bead of the mouth of the container. The dispensing openings of the lower wall of the conventional container seal communicate an interior of the container and the surrounding environment, and allow content, such as condiment, contained in the interior of the container to be poured out. The conventional container seal is movable between a covering position and an opening position.

When the conventional container seal is at the covering position, the central portion of the upper wall is convex relative to the container, and the peripheral outer portion of the upper wall tightly abuts against the rim portion of the lower wall, thereby covering the dispensing openings. By pressing the central portion of the upper wall, the peripheral outer portion of the upper wall pivots about the living hinge to covert the conventional container seal to the opening position to uncover the dispensing openings. The conventional container seal could be converted from the opening position to the covering position by pressing the peripheral outer portion of the upper wall.

When the conventional container seal is at the opening position, a space between the upper wall and the lower wall is relatively small, making it difficult to pour the condiment out of the container. In addition, since the area of the lower wall is relatively small, the size of each of the dispensing openings is limited such that only fluids and condiments with small grain sizes can be poured out of the container. If the conventional container seal is made with a larger dimension for a large container, it will be difficult to operate with single hand.

European Patent No. EP2199225 B1 discloses another conventional container seal that suffers the same issues associated with EP0790192 B1. Furthermore, the conventional container seal as disclosed in EP2199225 B1 includes more elements, making it more difficult to manufacture and assemble.

SUMMARY OF THE INVENTION

Therefore, the object of the present invention is to provide a container seal that can eliminate at least one of the drawbacks associated with the abovementioned prior arts.

Accordingly, a container seal of the present invention is adapted to be mounted to a mouth of a container. The container seal includes a positioning unit and a sealing unit. The positioning unit has a positioning member that is adapted to be mounted to the mouth of the container, a support member that is connected to the positioning member, and a passage that extends through the support member and the positioning member along an axis for communicating an interior of the container. The support member includes a surrounding wall, a fixing part and an abutting part. The surrounding wall defines a space communicating the passage and has a support surface at top of the surrounding wall. The support surface defines a top opening that communicates the space. The support surface is tilted relative to the axis. The fixing part extends from the surrounding wall into the space and is disposed at a side of the axis. The abutting part extends from the surrounding wall into the space and is disposed at another side of the axis opposite to the fixing part. The sealing unit of the container seal includes a cover member that is made of an elastic material, and a connecting member that extends from the cover member, that is located off a center portion of the cover member, and that is connected to the fixing part of the support member. The cover member has a rear end that is disposed at a side of the connecting member, a front end that is disposed at an opposite side of the connecting member and that corresponds in position to the abutting part of the support member, and a pressing portion that is disposed between the rear and front ends. The pressing portion is pressable to convert the cover member from a covering position to an opening position. When the cover member is at the covering position, the cover member is tilted relative to the axis with the front end being higher than the rear end, abuts against the abutting part of the support member, and covers the top opening. When the cover member is at the opening position, the cover member uncovers the top opening with the front end being away from the abutting part of the support member.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
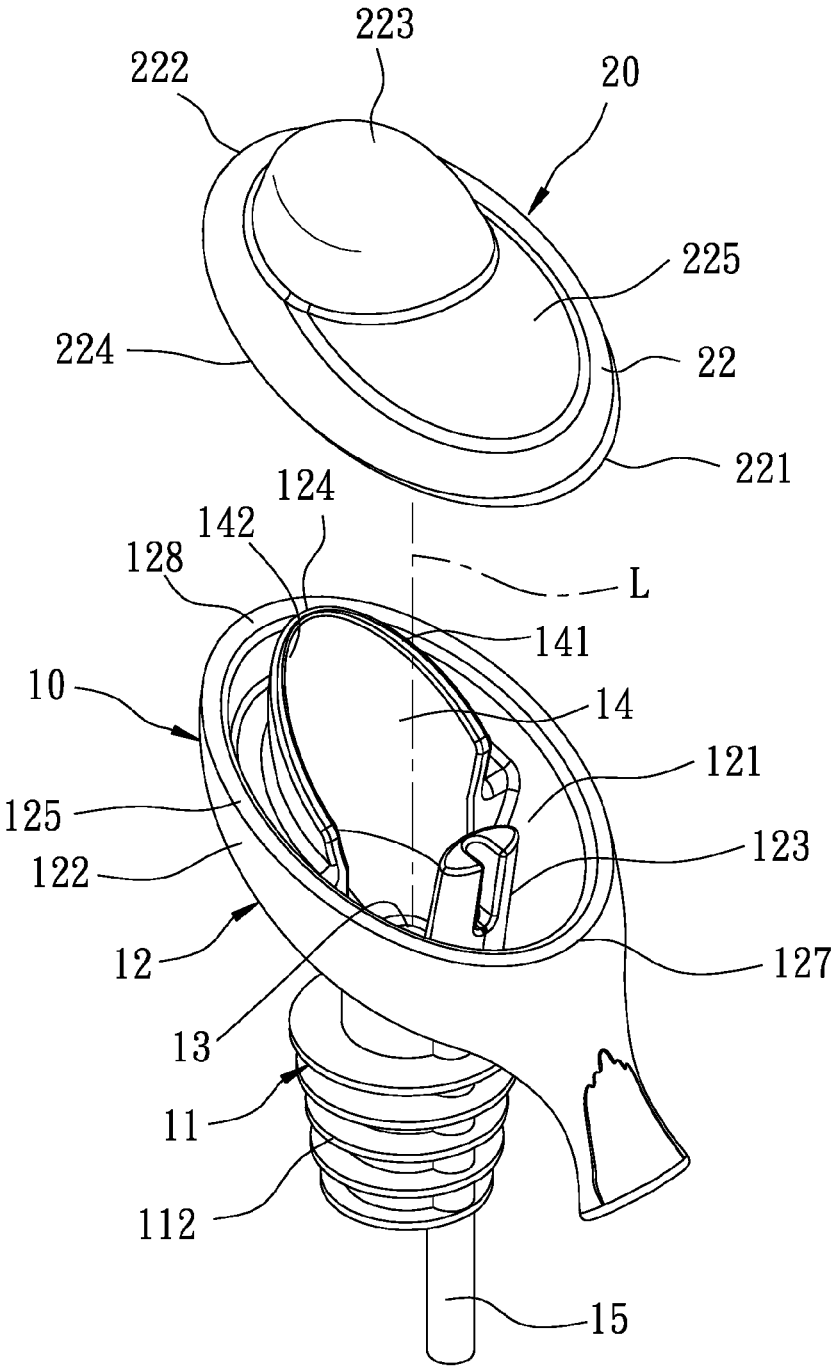
FIG. 1 is an exploded perspective view of an embodiment of a container seal according to the present invention.
Figure 2:
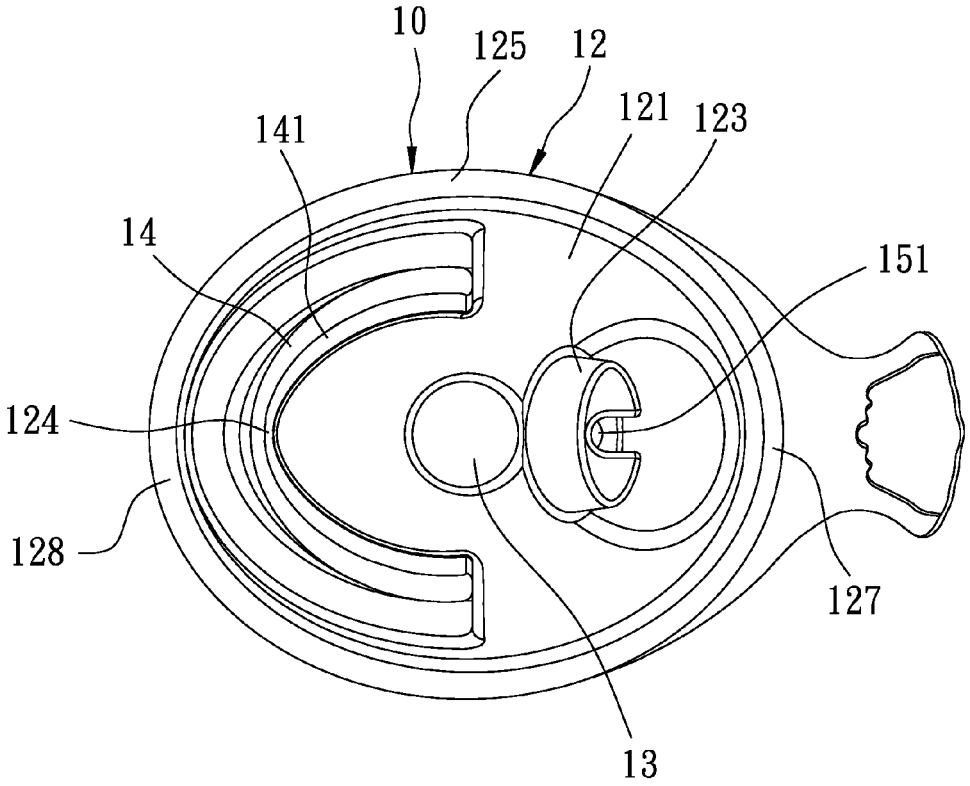
FIG. 2 is a top view of a positioning unit of the container seal.
Figure 5:
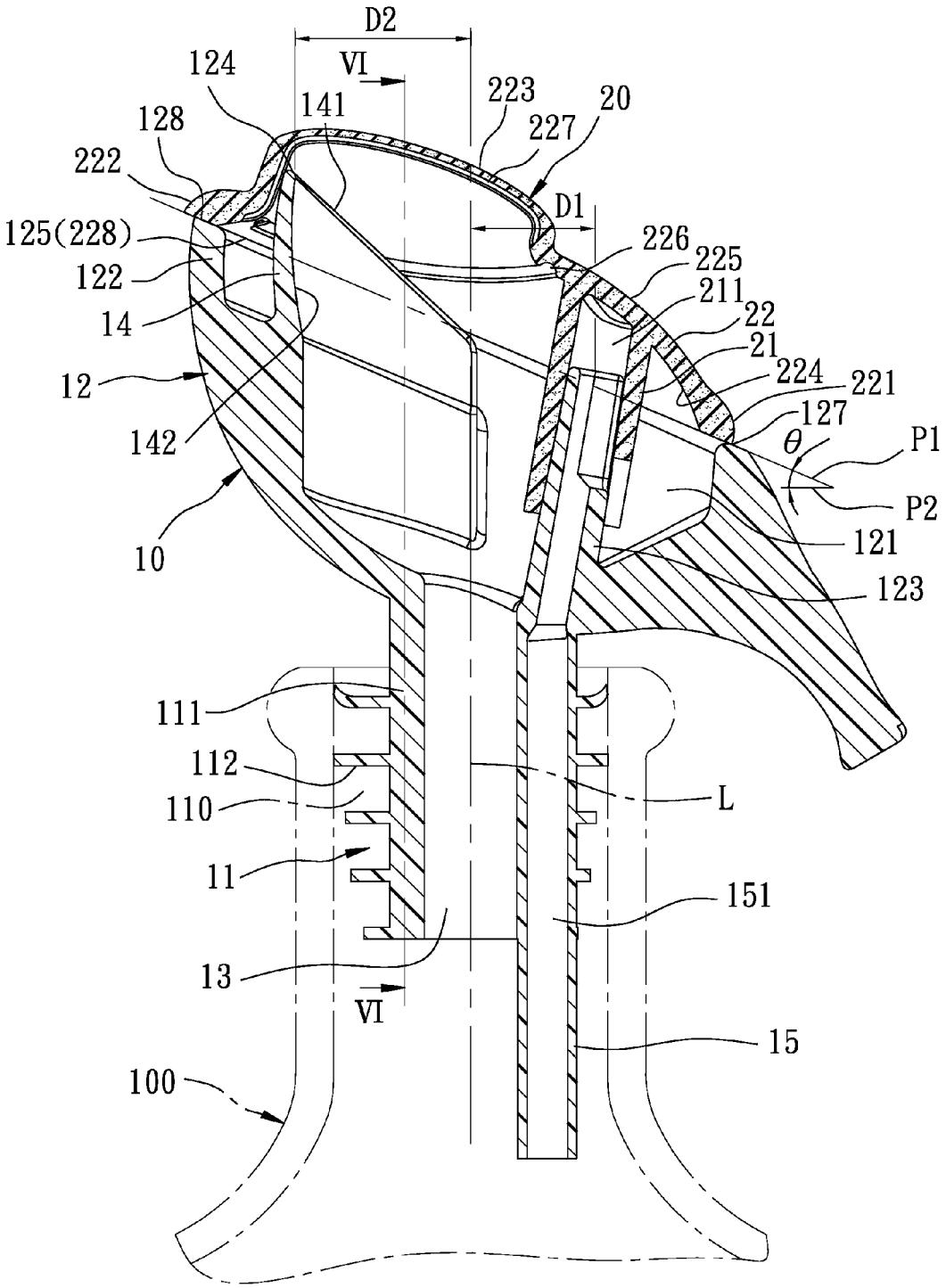
FIG. 5 is a sectional view of the container seal illustrating the container seal mounted to a mouth of a container and a cover member of the sealing unit at a covering position.

Referring to FIGS. 1, 2 and 5, an embodiment of a container seal according to the present invention is usable for being mounted to a mouth 110 of a container 100. The container seal includes a positioning unit 10 and a sealing unit 20. In the present embodiment, the positioning unit 10 and the sealing unit 20 are respectively made of plastic materials of different rigidity.

The positioning unit 10 has a positioning member 11 that is adapted to be mounted to the mouth 110 of the container 100, a support member 12 that is connected to the positioning member 11, a passage 13 that extends through the support member 12 and the positioning member 11 along an axis (L) for communicating an interior of the container 100, an outlet guiding wall 14 that is connected to the support member 12, and a venting member 15 that extends downwardly from the support member 12.

In this embodiment, the positioning member 11 includes a tubular wall 111 that surrounds the axis (L) and that defines the passage 13, and five ring-shaped blocking plates 112 that extend outwardly from the tubular wall 111 and that are spaced apart from one another along the axis (L). Outer diameters of the blocking plates 112 gradually increase along the axis (L) from one of the blocking plates 112 farthest from the support member 12 toward one of the blocking plates 112 closest to the support member 12. With the structural design of the blocking plates 112, the positioning member 11 can be tightly mounted to the mouth 110 of the container 100.

The support member 12 includes a surrounding wall 122 that defines a space 121 communicating the passage 13, a fixing part 123 that extends from the surrounding wall 122 into the space 121 and that is disposed at a side of an imaginary vertical plane that passes through the axis (L), and an abutting part 124 that extends from the surrounding wall 122 into the space 121 and that is disposed at another side of the imaginary vertical plane opposite to the fixing part 123. A largest distance (D1) between the axis (L) and the fixing part 123 is smaller than a largest distance (D2) between the axis (L) and the abutting part 124. The surrounding wall 122 has a support surface 125 on top thereof, defining a top opening that communicates the space 121. The support surface 125 is tilted relative to the axis (L). An included angle (θ) is formed between an imaginary plane (P1) which is defined by the support surface 125 and an imaginary horizontal plane (P2) which is perpendicular to the imaginary vertical plane. The included angle (θ) is not larger than 45°. In the present embodiment, the included angle (θ) is about 22°. The support surface 125 of the surrounding wall 122 has a rear support portion 127 and a front support portion 128 opposite to the rear support portion 127. The fixing part 123 and the abutting part 124 are disposed between the rear support portion 127 and the front support portion 128. The fixing part 123 is a protrusion that extends from a bottom portion of the surrounding wall 122 into the space 121 and toward the top opening.

The outlet guiding wall 14 has a U-shaped cross-section (see FIG. 2), and extends from the surrounding wall 122 into the space 121 and around the passage 13. The outlet guiding wall 14 has a top portion 141 that is distal from the surrounding wall 122 and that has a center section and opposite side sections extending respectively from opposite ends of the center section. The abutting part 124 of the support member 12 is formed at the center section. The top portion 141 is protruding relative to the surrounding wall 122 out of the space 121 and is at a height in the direction of the axis (L) that is higher than the support surface 125 of the surrounding wall 122 and that lowers from the center section toward the side sections. The outlet guiding wall 14 further has an outlet guiding surface 142 that faces the fixing part 123 of the support member 12, that is concave relative to the fixing part 123, and that is slightly inclined away from the axis (L) in a direction from the surrounding wall 122 to the top portion 141.

The venting member 15 extends downwardly from the support member 12 and parallel to the axis (L), and is connected to a side of the positioning member 11. The venting member 15 is formed with a vent channel 151 that is used for extending from the interior of the container 100 to the support member 12. To be more specific, the vent channel 151 extends to a middle portion of the fixing part 123, and communicates the interior of the container 100 and the space 121.

Figure 3:
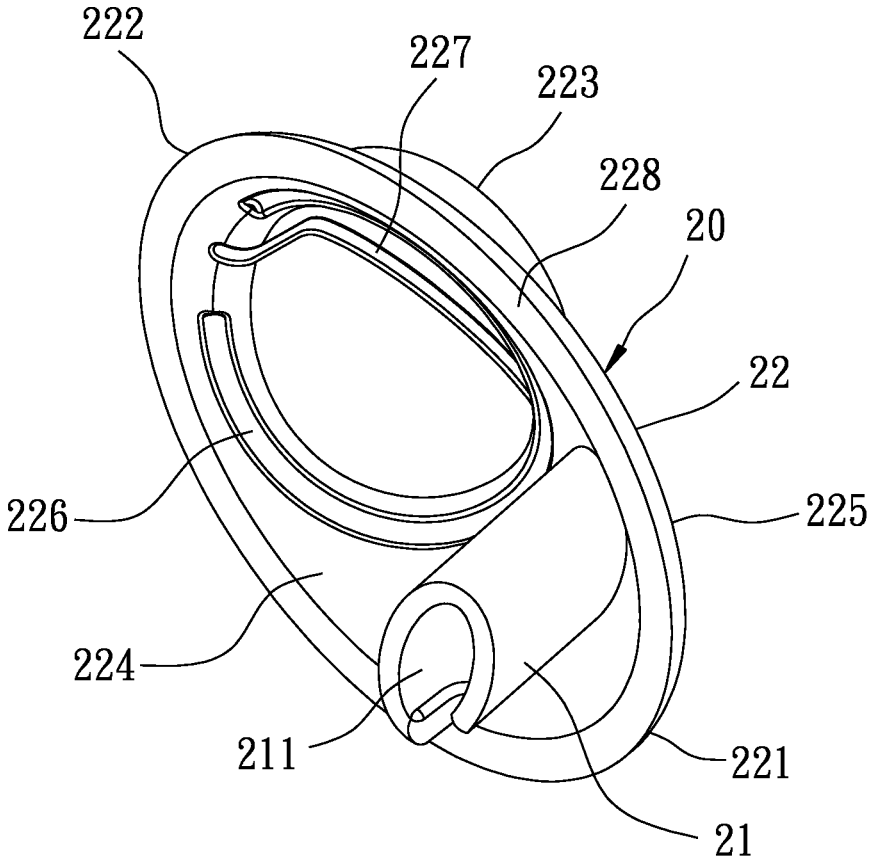
FIG. 3 is a bottom perspective view of a sealing unit of the container seal.
Figure 4:
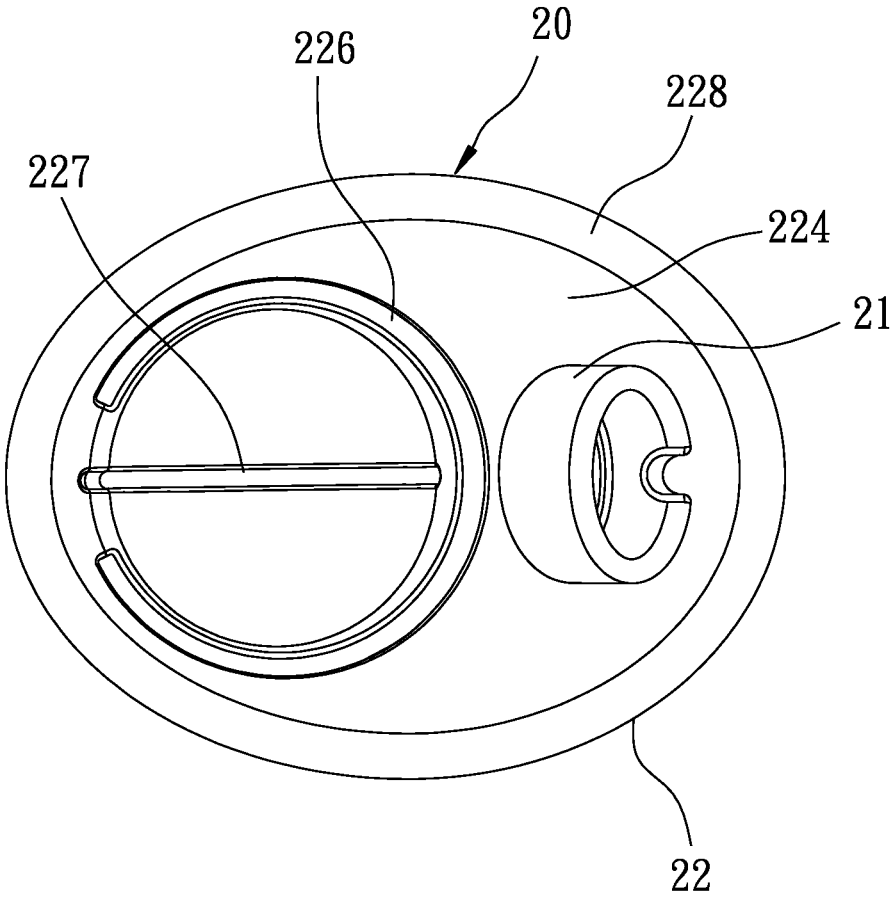
FIG. 4 is a bottom view of the sealing unit.
Figure 6:
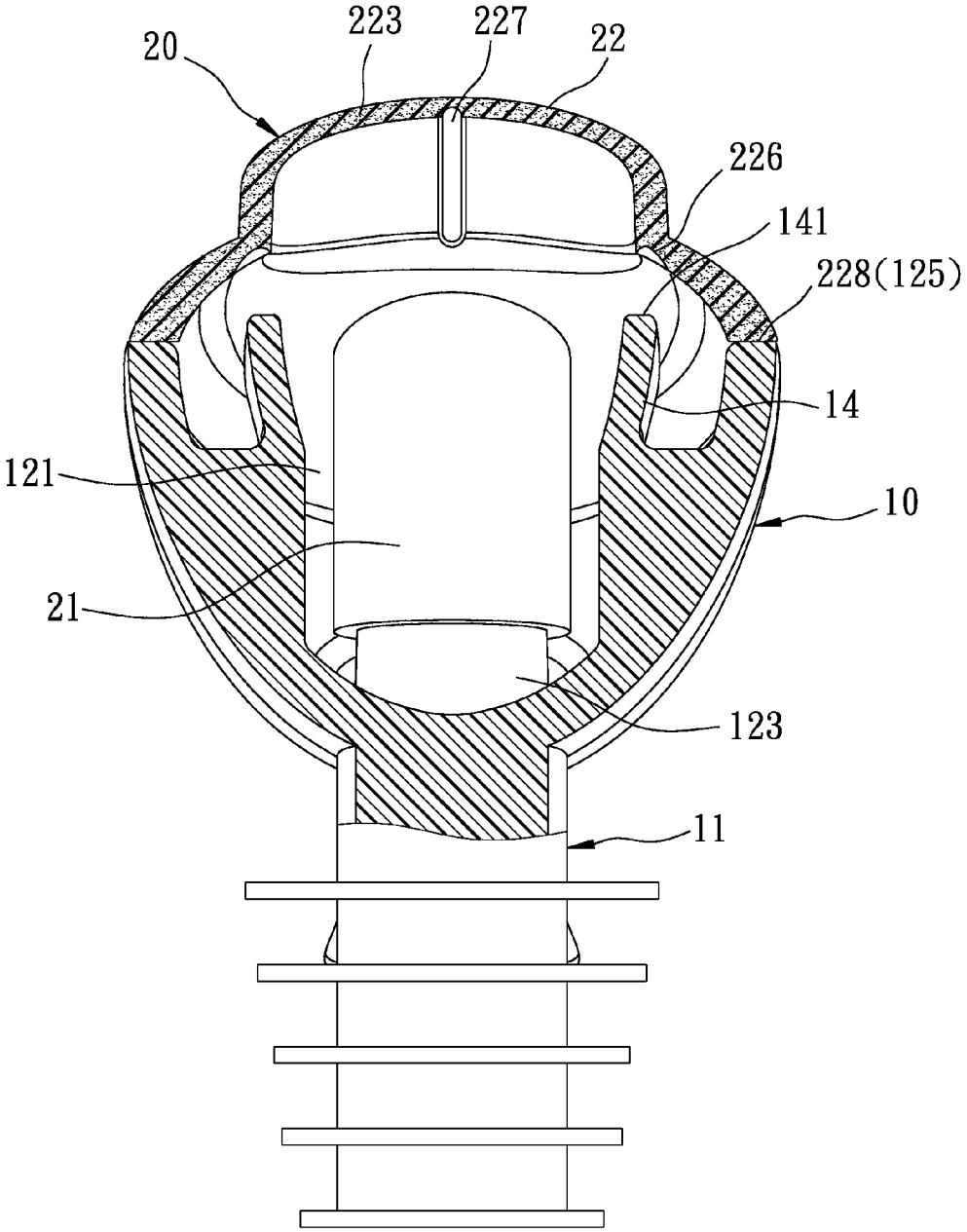
FIG. 6 is a fragmentary, partly sectional view of the container seal taken along line VI-VI of FIG. 5.

Referring to FIGS. 3 and 4, the sealing unit 20 includes a cover member 22 that is made of an elastic material, and a connecting member 21 that extends from the cover member 22, that is located off a center portion of the cover member, and that has an inserting hole 211 for detachable insertion of the fixing part 123 thereinto. The cover member 22 has a rear end 221 that is disposed at a side of the connecting member 21, a front end 222 that is disposed at an opposite side of the connecting member 21 and that corresponds in position to the abutting part 124 of the support member 12, a pressing portion 223 that is disposed between the rear and front ends 221, 222 and that is pressable to convert the cover member 22 from a covering position to an opening position, a bottom surface 224 that has a peripheral surface portion 228, a top surface 225 that is opposite to the bottom surface 224, a ring-shaped folding groove 226 that is formed in the bottom surface 224 and that extends along a periphery of the pressing portion 223, and a linear folding groove 227 that is formed in the bottom surface 224 and that extends from the front end 222 toward the rear end 221. As shown in FIG. 6, each of the folding groove 226 and the linear folding groove 227 is defined by an arc groove-defining surface.

FIG. 5 illustrates the cover member 22 at the covering position, where the cover member 22 is tilted relative to the axis (L) with the front end 222 being higher than the rear end 221, abuts against the abutting part 124 of the support member 12, and covers the top opening. The pressing portion 223 of the cover member 22 is convex relative to the top surface 225 and has an inverted U-shaped cross-section (see FIG. 6). The top portion 141 of the outlet guiding wall 14 is proximal to the pressing portion 223. The peripheral surface portion 228 of the cover member 22 abuts against the support surface 125 of the surrounding wall 122 with the front and rear ends 222, 221 of the cover member 22 contacting respectively the front and rear support portions 128, 127 of the support surface 125. With the top opening covered by the cover member 22, foreign matters such as dust could be kept from entering the container 100.

Figure 7:
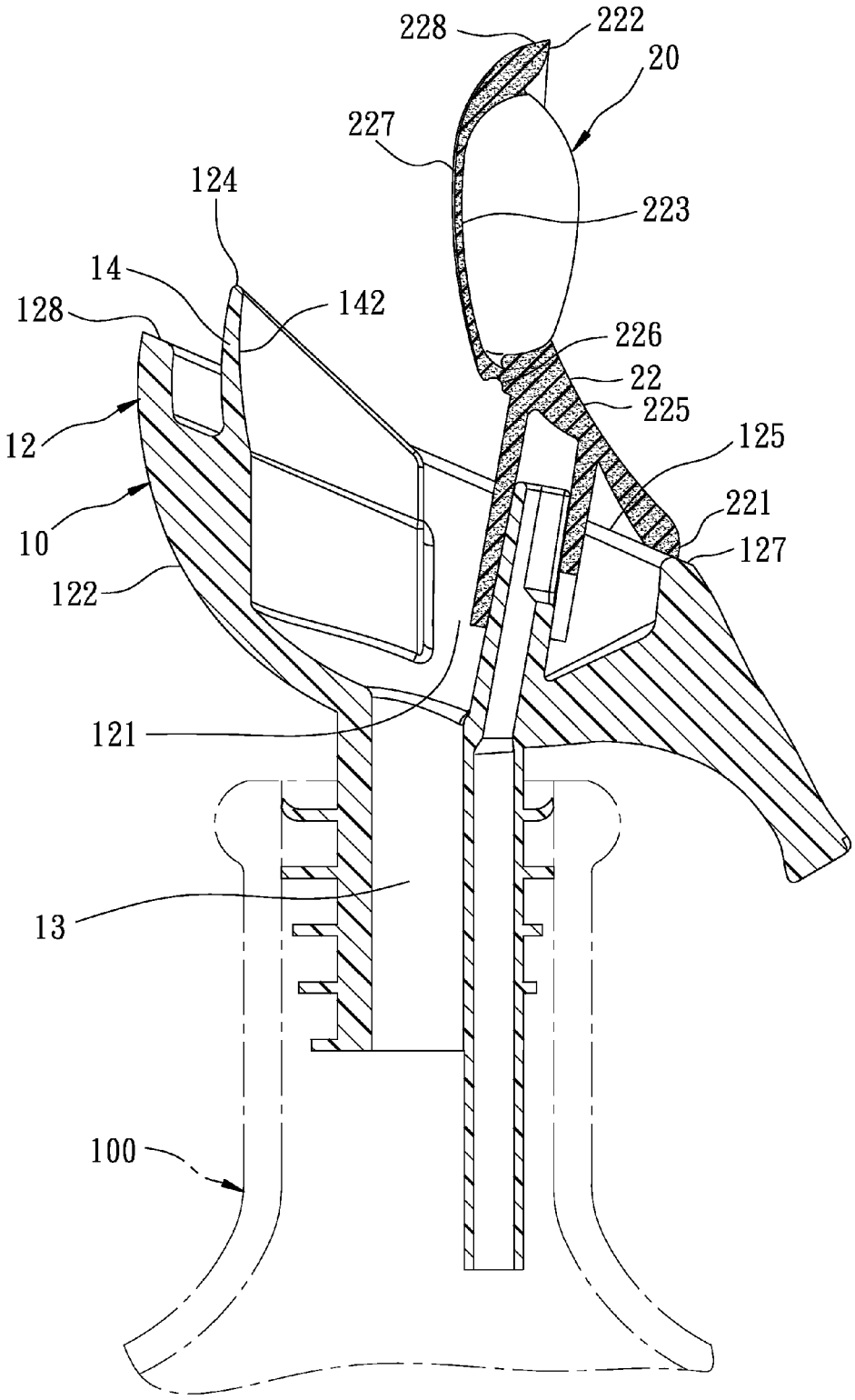
FIG. 7 is a view similar to that of FIG. 5, but illustrating the cover member of the sealing unit at an opening position.
Figure 8:
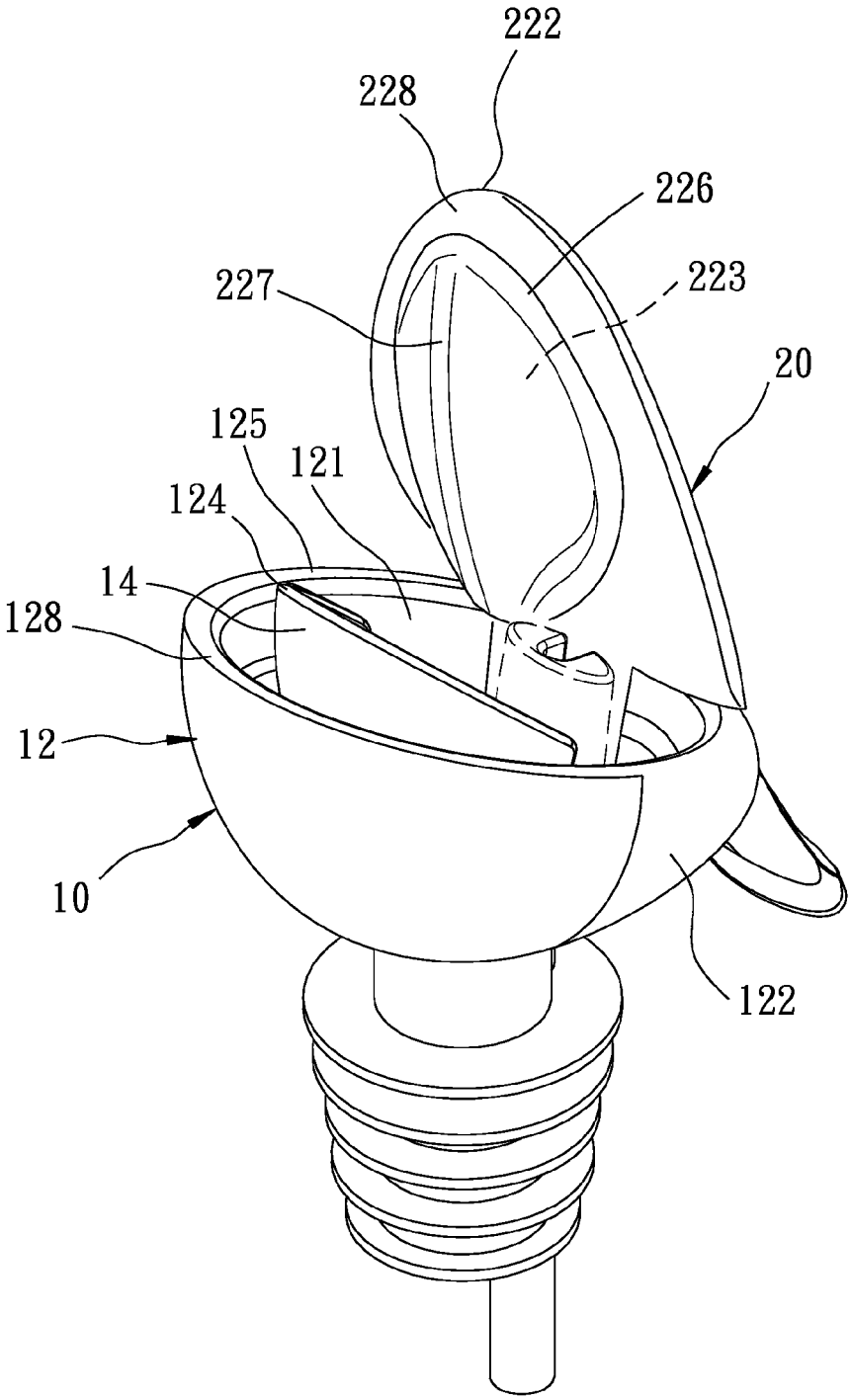
FIG. 8 is a perspective view of the container seal, illustrating the cover member at the opening position.

When the pressing portion 223 of the cover member 22 is pressed, the pressing portion 223 abuts against the abutting part 124 of the support member 12, uses the abutting part 124 as a fulcrum so as to be converted from being convex to being concave relative to the top surface 225, and to convert the cover member 22 from the covering position to the opening position. FIGS. 7 and 8 illustrate the cover member 22 at the opening position, where the cover member 22 uncovers the top opening with the front end 222 being away from the front support portion 128 of the support surface 125 of the surrounding wall 122 and the abutting part 124 of the support member 12. A matter such as a condiment contained in the container 100 can be poured out.

The linear folding groove 227 of the cover member 22 facilitates the conversion of the pressing portion 223 from being convex to being concave relative to the top surface 225 when the pressing portion 223 is pressed. The ring-shaped folding groove 226 facilitates the conversion of the cover member 22 from the covering position to the opening position.

To sum up, with the inclination of the cover member 22 relative to the axis (L) in the covering position, it is convenient for a user to operate the container seal with single hand. Moreover, with the structural design of the blocking plates 112 of the positioning member 11, the positioning member 11 can fit with containers 100 of various mouth sizes. Therefore, sizes of the tubular wall 111 of the positioning unit 10 and the sealing unit 20 of the container seal are less significant factors to consider regarding practical usage, and could be configured to desired sizes without taking into account the size of the mouth 110 of the container 100 to be used therewith. When the cover member 22 is at the opening position, a relatively large opening space is formed between the peripheral surface portion 228 of the bottom surface 224 of the cover member 22 and the center and side sections of the top portion 141 of the outlet guiding wall 14. Not only fluids, but matters of different sizes can be contained in the container 100 and be easily poured out. Furthermore, detachable engagement between the inserting hole 211 of the connecting member 21 of the sealing unit 20 and the fixing part 123 of the support member 12 of the positioning unit 10 facilitates removal of the sealing unit 20 from the positioning unit 10 for cleaning.

While the present invention has been described in connection with what is considered the practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A container seal adapted to be mounted to a mouth of a container, said container seal comprising:

a positioning unit having a positioning member that is adapted to be mounted to the mouth of the container, a support member that is connected to said positioning member, and a passage that extends through said support member and said positioning member along an axis for communicating an interior of the container, said support member including a surrounding wall that defines a space communicating said passage and that has a support surface at top thereof defining a top opening communicating said space, said support surface being tilted relative to the axis, a fixing part that extends from said surrounding wall into said space and that is disposed at a side of the axis, and an abutting part that extends from said surrounding wall into said space and that is disposed at another side of the axis opposite to said fixing part; and a sealing unit including a cover member that is made of an elastic material, and a connecting member that extends from said cover member, that is located off a center portion of said cover member, and that is connected to said fixing part of said support member, said cover member having a rear end that is disposed at a side of said connecting member, a front end that is disposed at an opposite side of said connecting member and that corresponds in position to said abutting part of said support member, and a pressing portion that is disposed between said rear and front ends and that is pressable to convert said cover member from a covering position, where said cover member is tilted relative to the axis with said front end being higher than said rear end, abuts against said abutting part of said support member, and covers said top opening, to an opening position, where said cover member uncovers said top opening with said front end being away from said abutting part of said support member.

2. The container seal as claimed in claim 1, wherein said positioning unit further has an outlet guiding wall that has a U-shaped cross-section, that extends from said surrounding wall into said space, and that is disposed around said passage, said outlet guiding wall having a top portion that is distal from said surrounding wall, and that has a center section at which said abutting part of said support member is formed, and opposite side sections which extend respectively from opposite ends of said center section, a height of said top portion in a direction of the axis decreasing from said center section toward said side sections, said outlet guiding wall further having an outlet guiding surface that faces said fixing part of said support member, and that is inclined away from the axis from said surrounding wall to said top portion.

3. The container seal as claimed in claim 2, wherein:

said cover member further has a bottom surface and a top surface opposite to said bottom surface;

when said cover member is at the covering position, said pressing portion is convex relative to said top surface and has an inverted U-shaped cross-section, and said top portion of said outlet guiding wall is proximal to said pressing portion; and when said cover member is at the opening position, said pressing portion is concave relative to said top surface.

4. The container seal as claimed in claim 3, wherein said cover member of said sealing unit further has a ring-shaped folding groove that is formed in said bottom surface and that extends along a periphery of said pressing portion.

5. The container seal as claimed in claim 4, wherein said cover member of said sealing unit further has a linear folding groove that is formed in said bottom surface and that extends from said front end toward said rear end.

6. The container seal as claimed in claim 5, wherein said top portion of said outlet guiding wall extends out of said space.

7. The container seal as claimed in claim 6, wherein:

said support surface of said surrounding wall of said positioning unit has a rear support portion and a front support portion opposite to said rear support portion, said bottom surface of said cover member having a peripheral surface portion; and when said cover member is at the covering position, said peripheral surface portion of said cover member abuts against said support surface with said front and rear ends of said cover member contacting respectively said front and rear support portions of said support surface of said surrounding wall.

8. The container seal as claimed in claim 1, wherein said fixing part of said support member of said positioning unit is a protrusion that extends from a bottom portion of said surrounding wall into said space toward said top opening, said connecting member of said sealing unit having an inserting hole that is for detachable insertion of said fixing part thereinto.

9. The container seal as claimed in claim 8, wherein said positioning unit further has a venting member that extends downwardly from said support member and that is formed with a vent channel adapted for extending from the interior of the container to said fixing part of said support member.

10. The container seal as claimed in claim 1, wherein said positioning member includes a tubular wall that surrounds the axis and that defines said passage, and a plurality of ring-shaped blocking plates that extend outwardly from said tubular wall and that are spaced apart from each other along the axis, outer diameters of said blocking plates gradually increasing toward said surrounding wall.

* * * * *